United States Patent [19]

McMullan et al.

[11] 4,233,492

[45] Nov. 11, 1980

[54] WATER BED WITH HEATER

[75] Inventors: James P. McMullan, 2630 Seaman Ave., El Monte, Calif. 91733; Rudy E. Lindsay; Jerry E. Land, both of Garden Grove, Calif.

[73] Assignee: James P. McMullan, El Monte, Calif.

[21] Appl. No.: 86,281

[22] Filed: Oct. 19, 1979

[51] Int. Cl.[3] ..... H05B 3/00

[52] U.S. Cl. ..... 219/217; 5/422; 128/376; 219/523; 219/526; 219/528

[58] Field of Search ..... 219/211, 212, 427, 217, 219/526, 313, 528, 527, 523, 549; 5/284, 317 R, 370, 366; 128/33, 376

[56] References Cited

U.S. PATENT DOCUMENTS

| | | | |
|---|---|---|---|
| 3,014,117 | 12/1961 | Madding | 219/524 |
| 3,585,356 | 6/1971 | Hall | 219/217 |
| 3,746,835 | 7/1973 | Yu et al. | 219/217 |
| 3,760,147 | 9/1973 | Tyrey | 219/217 |
| 3,790,753 | 2/1974 | Miller | 219/528 |
| 3,819,905 | 6/1974 | Trestler | 219/501 |
| 3,869,594 | 3/1975 | Shively | 219/211 |
| 3,879,598 | 4/1975 | Darling | 219/217 |
| 4,064,387 | 12/1977 | McMullan | 219/506 |
| 4,097,717 | 6/1978 | Phillips | 219/217 |
| 4,114,215 | 9/1978 | Sauto | 3/370 |

*Primary Examiner*—Volodymyr Y. Mayewsky
*Attorney, Agent, or Firm*—Georges A. Maxwell

[57] ABSTRACT

The combination of a water filled flotation bed mattress with a filler neck and an elongate flexible cord-like heater structure comprising an elongate power supply cord section with inside and outside end portions and a filler neck engaging and sealing means between its end portions and engaged in and sealing said neck with said inside end portion extending into the mattress and the outside portion extends from the mattress, an elongate flexible resistance heater section with inner and outer ends arranged within the mattresses and including a water proof jacket structure and an elongate resistance element within extending from the inner to the outer end and thence to the inner end of jacket structures; and temperature control means including an elongate rigid metal tube with inner and outer ends engaged with and between the free end of said inside portion of the cord section and the inner end of the heater section, insulated conductors extending through the tube and connecting ends of the element with related ends of conductor lines in the cord section and a normally closed thermostatic switch within and engaging the tube and connected in series in one of the insulated conductors, whereby current through the heater section is shut off when the temperature of the water raises the temperature of the tube and switch to a predetermined maximum temperature and whereby the cord section of the heater extending through and from the filler neck is not resistively heated.

9 Claims, 8 Drawing Figures

Fig. 1.
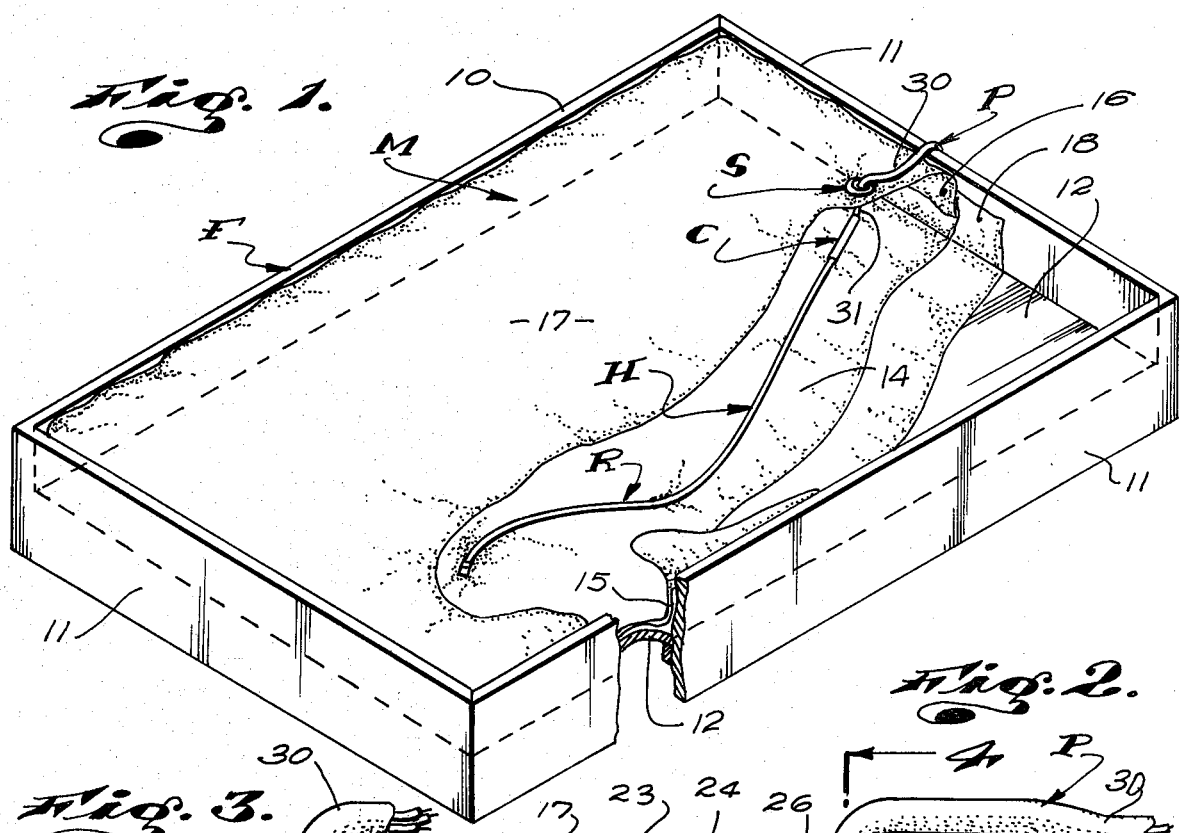
Fig. 2.
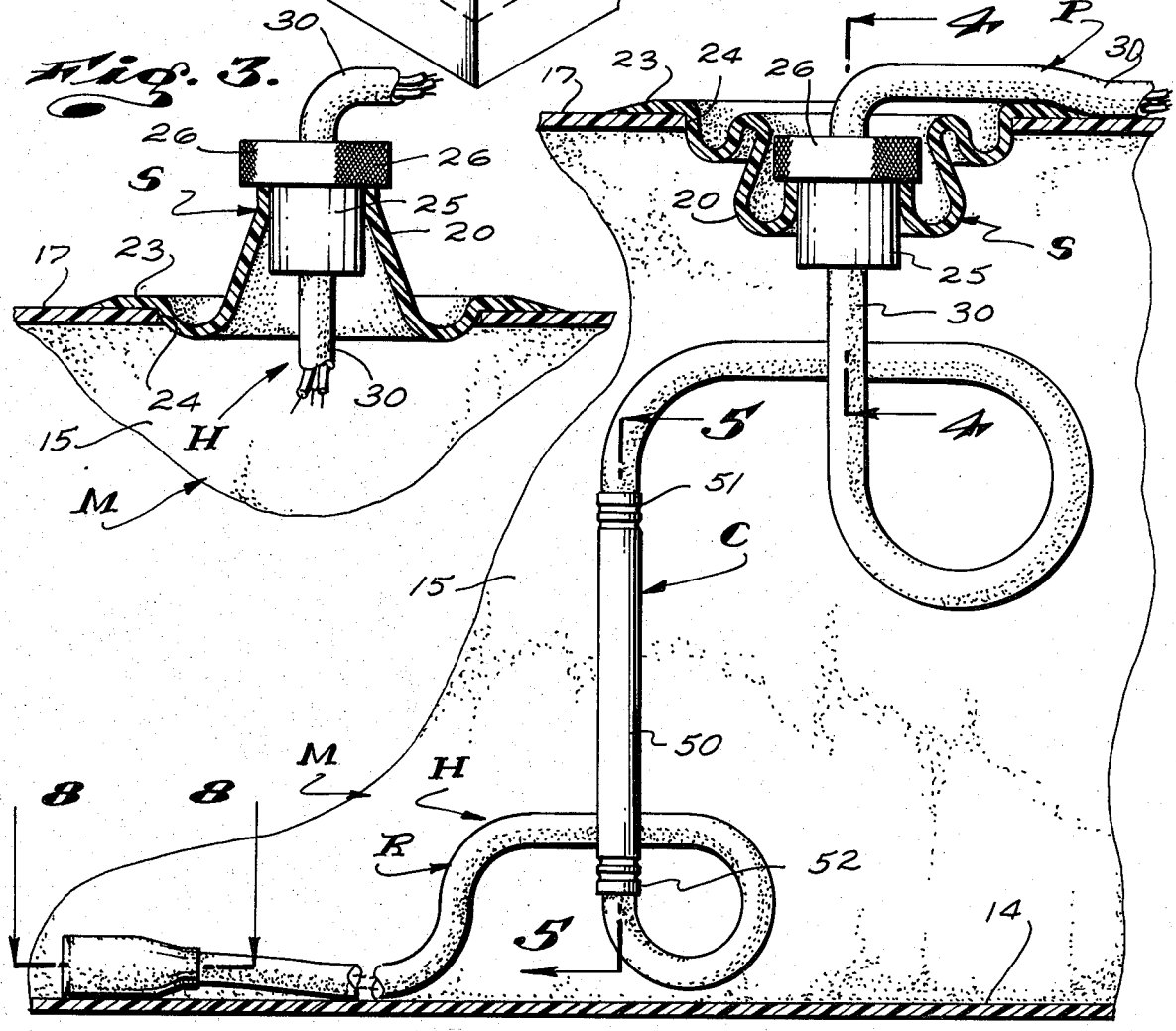
Fig. 3.

WATER BED WITH HEATER

This invention has to do with a resistance heater and is particularly concerned with a novel heater bed structure.

BACKGROUND OF THE INVENTION

The ordinary water bed comprises a flat horizontal mattress supporting platform, a mattress retaining frame about and projecting upwardly from the platform and a water-filled bladder-like flotation mattress of flexible plastic film supported atop the platform within and retained by the frame.

The ordinary flotation mattress is characterized by normally flat, horizontal top and bottom walls and vertical side and end walls of thin, polyethelene sheet stock or the like.

The top wall of such mattresses are provided with tubular filler stems to facilitate filling the mattresses with water.

The filler stems are preferably and commonly specially formed so that they are axially collapsible to normally occur below the top plane of the top walls of the mattresses and such that they can be pulled or drawn vertically and out of the mattresses to afford convenient access thereto.

The most common and preferred form of mattress filler stem is normally closed by a screw cap threaded about and overlying the open free end of the stem and by a plug carried by the cap and engaged in the stem. The plug serves to support the portion of the wall of the stem which occurs within and is engaged by the cap In addition to the foregoing, the ordinary water bed is provided with and includes an electric resistance heater unit which operates to heat and to thereafter maintain the water filled mattress at a desired and predetermined temperature.

Most water bed heaters provided by the prior art have been in the form of flat, horizontal blanket-type heaters and have been arranged in flat engagement with and between the platforms and the bottom walls of the mattresses with which they are related.

The power supply lines for the heaters extend laterally outwardly from between the platforms and mattresses and are thence suitably extended to related control means and/or power sources at the outside of and remote from the bed structures.

One undesirable feature of the above noted forms of heaters resides in the fact that the heaters, while establishing direct heat conducting contact with the mattresses. establishes similar contact with the platforms to conduct much of the heat which is generated by the heaters into the platforms where it serves little useful purpose and is essentially wasted.

Another undesirable feature of the above noted form of heater resides in the fact that their efficient surface area is limited or small with respect to the surface area of the mattresses with which they are related. As a result of the foregoing, such heaters are only capable of heating small areas of the mattresses with which they are related. Distribution of heat throughout the mattresses depends upon circulation or convection currents in the water within the mattresses, which is oftentimes extremely slow and of questionable effectiveness.

Ordinary water bed or flotation mattresses vary in vertical extent or depth from about 4 inches to about 8 inches and are provided in the several plan shapes and sizes in which conventional beds are provided.

OBJECTS AND FEATURES OF THE INVENTION

An object and feature of this invention is to provide a novel combination flotation mattress and heater wherein the heater is within the mattress.

Another object and feature of this invention is to provide a combination mattress and heater assembly wherein the heater is an elongate flexible unit which is freely engageable in the mattress through the filler stem of the mattress.

Yet another object and feature of the invention is to provide a novel elongate heater structure engageable through a mattress filler stem, which heater structure has a plug intermediate its ends to engage in and to seal the free open end of the filler neck and from which an elongate flexible power supply cable portion freely extends at the exterior of the mattress.

Still another object and feature of the invention is to provide a structure of the character referred to above wherein the heater is an elongate flexible unit in the nature of a flexible electric service cord or the like and extends from the plug to extend freely and randomly about the interior of the mattress so that heat generated by the heater is widely distributed within the mattress.

It is an object and feature of the invention to provide a heater of the character referred to which includes an elongate flexible resistance heater element in sealed relationship within the waterproof dielectric plastic jacket and a heater wherein the element is such that its resistance decreases as the temperature of the element increses whereby the heater is substantially temperature self-regulating.

An object and feature of the invention is to provide a heater structure of the character referred to above which includes a normally closed temperature responsive switching unit which is maintained cool and in its closed position by water in the mattress and which is heated by the element and opened to stop the flow of current through the element when the water becomes overheated and/or when the heater is energized without the presence of adequate water in the mattress and about said unit.

It is an object and feature of the invention to provide a temperature responsive switching unit of the character referred to above which includes an elongate rigid heat conducting metal tube section engaged in and between opposite end portions of the elongate heater, a thermostatic switching device in the tube section and connected with and between one end of the heating element and an end of a power supply conductor; and a structure wherein the end portions of the element extend through said tube, adjacent the device, whereby the tube section and the device are heated by those related end portions of the element.

An object and feature of the invention is to provide a heater structure of the character referred to wherein the tube section is arranged between an elongate flexible section of the heater through which the heater element extends and an elongate flexible section of the heater through which low resistance flexible power supply conductors extend and which carries the filler stem engaging plug at its free end, whereby the filler stem structure is not heated directly by the heater and the rigid tube is supported and arranged within the mattress so that it cannot establish vertical load supporting engagement with and/or between related walls of the mattress structure.

Finally, it is an object and feature of the invention to provide a retaining cap screw threaded about the free end portion of the filler stem to engage and retain the plug in the stem and through which a power supply cable extending from the plug freely extends.

The foregoing and other objects and features of the invention will be apparent and will be fully understood from the following detailed description of one typical preferred form and carrying out of the invention, throughout which description reference is made to the accompanying drawings.

DESCRIPTION OF THE DRAWINGS

FIG. 1 is an isometric view of a water bed embodying the invention and having portions broken away to better illustrate details of the invention;

FIG. 2 is an enlarged view of a portion of the structure shown in FIG. 1;

FIG. 3 is a view of a portion of the structure shown in FIG. 2, with parts in different positions;

DETAILED DESCRIPTION OF THE INVENTION

Figure 4:
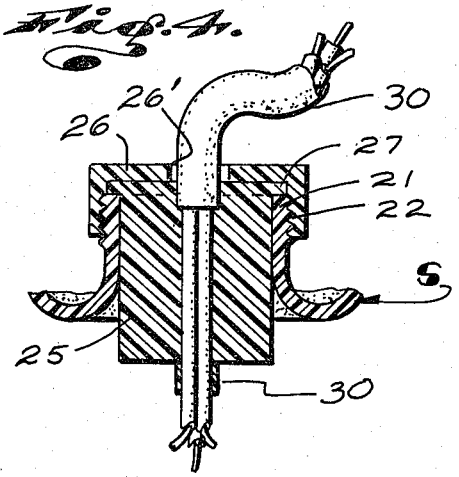
FIG. 4 is an enlarged detailed sectional view taken as indicated by line 4—4 on FIG. 2.

Referring to the drawings, the heater H provided by this invention is shown related to or in combination with a conventional water bed structure A comprising a frame F and a flotation or water mattress M.

The bed frame F comprises a rectangular frame work including laterally spaced vertical side boards 10, spaced vertical end boards 11, and a flat horizontal platform 12 within and supported by the boards 10 and 11 in predetermined vertical spaced relationship below the upper edges of said boards. For example, the platform is spaced about 8" below the upper edges of the boards.

The mattress M is a bladder-like unit established of flexible plastic sheeting such as polyvinylchloride sheeting and is characterized by a flat horizontal bottom wall 14 in flat supported engagement atop the platform 12, vertical side and end walls 15 and 16 in flat supported or retained engagement with the inside surfaces of the side and end boards 10 and 11 and a normally substantially flat horizontal top wall 17 in vertical spaced relationship above the bottom wall and on a horizontal plane substantially coincidental with the plane on which the upper edges of the side and end boards occur.

In accordance with common practice, a plastic sheet liner 18 is shown arranged between the mattress M and its opposing surfaces of the bed frame structure. Finally, the mattress M is provided with a filler stem structure S to facilitate filling the mattress with water and to facilitate evacuating air from within the mattress.

The mattress M can be fabricated of plastic sheeting in accordance with any one of many different patterns and fabricating techniques, without departing from the spirit of the invention.

So as not to unduly burden the drawings and obscure the invention, the body of water within the mattress has not been shown or designated by hatching or the like. It is sufficient to note that the space within and/or defined by the several walls of the mattress is filled or occupied by a body of water or other suitable fluid medium.

The filler stem structure S can vary widely in practice. In accordance with normal and desired practice, the structure S is located in the top wall 17 of the mattress in close relationship with one side or end thereof. In the case illustrated, the structure S is located close to one end of the mattress at a point substantially midway between the opposite sides thereof.

Further, in accordance with common and desired practice, the structure S includes an elongate flexible tubular stem 20 with an outer open free end 21 and an inner end which is sealingly engaged with and/or fixed to the top wall 17 and which communicates with the interior of the mattress.

The flexible filler stem 20 is such that it can be manually urged downwardly to normally occur within the mattress and such that it can be manually engaged and drawn upwardly from the mattress where its outer free end is conveniently accessible for connecting with a water hose or the like, to facilitate filling the mattress with water.

To facilitate axial movement of the tubular stem into and out of engagement in the mattress in the manner noted above, the stem 20 is tapered or conical so that it can be readily turned or drawn into itself, as shown in FIG. 2 of the drawings.

Further, to facilitate connecting the tube 20 with a conventional garden hose or the like the outer free end portion of the stem is externally threaded as indicated at 22 in FIG. 4 of the drawings.

The inner end of the tubular stem can be provided with a flat radially outwardly projecting annular mounting flange 23 which flange is fixed to the top surface of the top wall 17 of the mattress, as by welding, about an access opening 24 in the wall 17, provided for the structure S.

In addition to the foregoing, the filler stem structure S includes a plug 25 removably engaged in and closing the outer free end portion of the stem and a screw cap 26 engaged over and about the free end of the stem to retain the plug. In practice, the plug 25 has a radially outwardly projecting stop flange 27 to overlie the end of the stem and prevent the plug from advancing inwardly through the stem. The flange is normally held in tight clamped sealing engagement with and between the annular free end or edge of the stem and the cap 26. In addition to closing the stem, the plug serves to support the threaded portion of the stem so that it will not collapse and move out of engagement with the cap.

While the filler stem structures provided for and used throughout the water bed art vary in certain details of construction, the most common, most effective and desirable forms of filler stem structures are essentially the same as that structure which is shown in the drawing and described above.

With rare exception, the filler stems for water bed mattresses are collapsible so that they can be moved into the confines of the mattress when not in use; are externally threaded at their free ends to facilitate their being connected with water supply hoses and the like and are normally closed by a plug and cap unit or assembly.

The heater H provided by this invention is an elongate flexible unitary structure which, for the most part, resembles a conventional heavy duty extension cord in appearance.

The heater H first includes an elongate flexible power supply section P with inside and outside portions 30 and 31 and an intermediate plug portion 25. The plug portion 25 of the section P is a substitute for the aforementioned plug which is removably engaged in and closes the filler stem 20 of the mattress M with which the heater is related.

But for the plug 25, the power supply section P is in the nature of an elongate flexible, plastic jacketed service cord having a pair of flexible power lines 35 and 36 and a flexible ground line 37.

The plug 25 is in the nature of a cylindrical enlargement between the ends of the section P and defines the inside and outside portions 30 and 31 thereof. The plug 25 can be a separate part slidably engaged about the section P to its desired location and thereafter welded or bonded to the section or can be an enlargement formed integrally with the section by a suitable molding process.

The plug 25 is normally releasably engaged in the filler neck 20 of its related mattress M with the outside portion 31 of the section P extending from the water bed structure to a suitable power supply (not shown) and with its inside portion 30 extending through the neck 20 and into the interior of the water filled mattress M.

In practice, the free end of the outside portion 31 is provided with a conventional service plus (not shown) to facilitate connecting the section with a suitable power supply unit with a conventional service outlet (not shown).

The screw cap 26 engageable about the threaded portion of the stem 20 and overlying the plug, to hold the plug in the stem, has a central opening 26' through which the outside portion 30 of the section P freely extends.

The heater H next includes an elongate rigid control section C with inner and outer ends and an elongate flexible resistance heater section R with inner and outer ends. The outer end of the control section C is suitably connected with the inner free end of the inside portion 30 of the supply section P and the outer end of the section R is suitably connected with the inner end of the section P, whereby the section R extends or continues from the inner free end of the section P, with the rigid control section C interposed therebetween.

The flexible resistance heater section R includes a single flexible ground line 37' and a pair of flexible resistance lines 35' and 36' arranged in spaced parallel insulated relationship within and coextensive with a heavy plastic (polyvinylchloride) jacket J. The lines 35 and 36 extend freely from the inner or free end of the section R and are suitably spliced or electrically joined together as at 40 (see FIG. 8 of the drawings) so that those lines establish a single resistance element extending uninterruptedly from the outer end to the inner end and thence back to the outer end of the section R.

Figure 8:
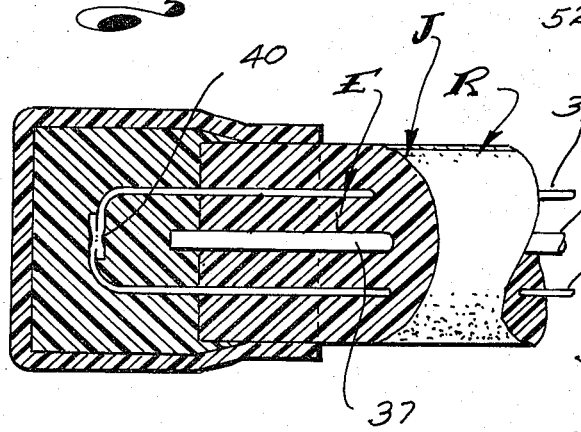
FIG. 8 is an enlarged detailed sectional view taken as indicated by line 8—8 on FIG. 2.

The spliced together end portions of the lines 35' and 36' and the free forward end of the ground line 37 of the section R are within and protected by a mass or body of potting material 41 within a plastic capsule 42 which is sealingly engaged about and which extends forwardly from the inner free end of the section R, as clearly indicated in FIG. 8 of the drawings.

The control section C comprises an elongate rigid, heat conducting metal tube 50 with an outer end portion engaged about the inner free end of the section P and roll-formed into secure sealed engagement therewith and an inner end portion 52 engaged about and roll-formed into secure sealed engagement with the outer end of the heater section R. The intermediate portion of the tube 50 between the end portions 51 and 52 thereof defines a chamber X.

The control section C next includes an elongate normally closed thermostatic switching unit U or an equivalent temperature responsive switching device in the chamber X. The unit U is arranged in heat conducting contact with the tube along at least one side thereof, as shown in FIGS. 5 and 6 of the drawings.

Figure 5:
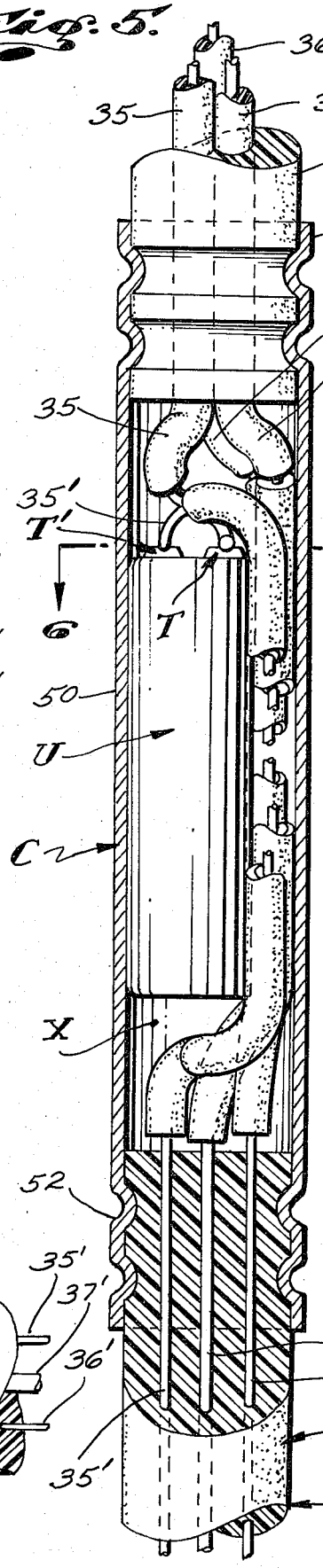
FIG. 5 is an enlarged detailed sectional view taken as indicated by line 5—5 on FIG. 2.
Figure 6:
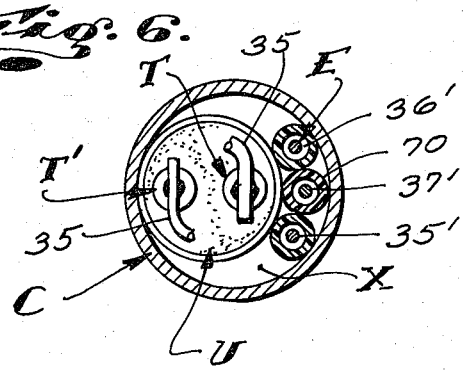
FIG. 6 is a sectional view taken as indicated by line 6—6 on FIG. 5.

One power line in the section P, for example, the power line 35, is extended into the chamber X and is connected with one terminal T of the unit U and one end of the element E, for example, the end of the element defined by the outer end of the line 35' of the section R is extended through the chamber X and is connected with the other terminal T' of the unit U, as shown in FIGS. 5 and 6 of the drawings.

Figure 7:
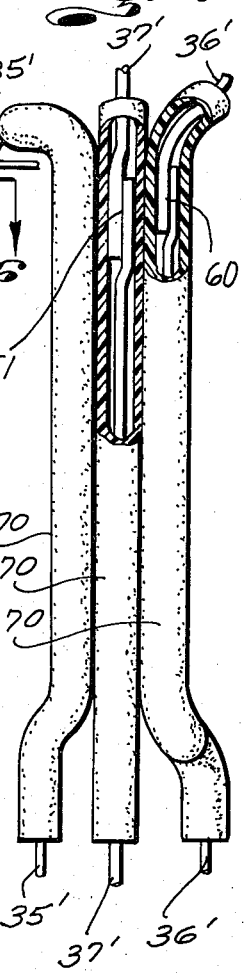
FIG. 7 is a view of related parts shown separately from other parts of the construction.

The other end of the element E, defined by the outer end of the line 36' of the section R is extended into and through the chamber X and is connected with the other power line 36 of the power supply section P, as shown at 60 in FIG. 7 of the drawings.

The ground line 37 extending from the outer end of the section R extends into and through the chamber X and is connected with an end of the ground line 37 of the section P extending into the chamber X, as shown at 61 in FIG. 7 of the drawings.

In practice, and as shown in the drawings, the end portions of the element E defined by the outer end portions of the resistance lines 35' and 36' of the section R are arranged to extend longitudinally in the chamber and longitudinally of and adjacent to the unit U so that the unit U and the tube 50 are normally heated by those related portions of the element E.

In practice, when the control section C is submerged in water within its related mattress M, and the element E is energized, the heat generated by the portions of the element within the tube 50 is conducted through the tube and into the surrounding water at a sufficient rate so that the temperature of the unit U is not elevated or raised to the set operating temperature of that unit.

In the event that the heater is energized when the tube 50 is not submerged in water and so that the heat generated by the portions of the element within the tube is not conducted away and dissipated, the unit U is rapidly heated to its set operating temperature and the switching means thereof opens to stop the flow of current through the element before the temperature of the heater structure can rise to dangerous or destructive limits.

In practice, and to facilitate manufacture and assembly of the construction, the lines 35', 36' and 37' of the heater section R at the rear end of that section are stripped of the jacketing material of the jacket J and are insulatively protected by insulating sleeves of polyolefin heat shrink tubing 70 as they extend longitudinally in the chamber X of the tube and longitudinally of the unit U.

The unit U is sufficiently small in cross-section and/or the interior of the tube is sufficiently large in cross-section so that adequate space is provided within the tube adjacent to and longitudinally of the unit to snugly accommodate the lines 35', 36' and 37' and their related insulating sleeves 70 as clearly shown in FIGS. 5 and 6 of the drawings.

Since it is necessary that the lines 35' and 36' or the opposite end portions of the element E defined by those lines extend longitudinally of the unit U and the tube 50, and the elongate unit U having its terminals T and T' at one end is selected and that unit is arranged within the tube 50 with its terminal end disposed toward the outer end of the tube and remote from the front end of the tube and its related outer end of the section R so that the opposite end portions of the element E need only extend in one direction longitudinally of and within the tube 50 and relative to the unit U, whereby the desired relationship of parts is attained in a minumum of space.

In practice, the element E established by the lines 35' and 36' of the section R are established of a metal having resistive characteristics which vary in response to the temperature of the element. More partticularly, the element is such that as its temperature increases, its resistance decreases whereby the heater is normally self-regulating. The control section C is required and is provided for those instances when, for one reason or another, the construction might become overheated.

In practice, it is generally considered undesirable to arrange a heater in direct contact with any part or portion of the vinyl plastic sheeting of a water bed mattress which is subject to being worked or flexed in the normal course of its use, since cylclical heating and cooling of the plastic tends to cause embrittlement of the plastic over protracted periods of time.

With the heater structure here provided, it will be apparent that the heater section H is remote from and does not heat the filler stem structure, is remote from the top wall of the mattress and is freely movably related to the normally static bottom wall of the mattress. Further, in normal use of the bed and as a result of surging of the water in the mattress, the heater section H is caused to move about in the mattress, atop the bottom wall thereof so that no part or portion of the mattress is subject to being heated and cooled over protracted periods of time.

In practice, the inside portion 30 of the section P, between the plug 25 and the section C, can be about 6" long; the section C need only be about 4" long and the section N can, for example, be about 6 ft. long. With such a relationship, when the mattress is about 8" deep, it will be apparent that the length of the flexible inside portion of the section P allows or permits the section C to assume a substantially horizontal or close to horizontal disposition in the matress when it is not subject or capable of being disposed to any vertical extent or angle which would allow or permit it to be subjected to vertical loads between the top and bottom walls of the mattress, and which could result in damage to both the heater and the mattress. Further, the section H of greater length is such that it can and will extend radially on and about the bottom wall of the mattress in such a manner that the heat generated thereby is well distributed throughout the mattress or throughout portions thereof. Further, surging of the water in the mattress, during normal use thereof, maintains the heater section in constant motion about the bottom thereof.

While the heater has been shown related to and in combination with a conventional water bed structure, it will be apparent that it can be advantageously related to and is particularly suitable for use in combination with that form of water bed which utilizes a thin, or less deep, flotation mattress arranged atop and supported by a soft resilient foam plastic mattress pad. This different form of water bed is a common hybrid type of bed wherein certain attributes of both flotation beds and conventional beds are sought to be attained. The flotation mattresses in such hybrid beds are commonly about 4" deep.

The effective heating of the flotation mattresses in hybrid beds such as referred to above has presented great problems since the blanket type prior art heaters for such beds must be arranged between the bottom walls of the flotation mattresses and the top surfaces of their related resilient foam pads and are subject to being forcibly bent, flexed and otherwise worked during normal anticipated use of the beds. Such working of such heaters results in premature fatiguing and irreparable damage to the heaters.

Use of the heater of the present invention in combination with the flotation mattresses of the above noted hybrid beds is most desirable and effective since the flexible heater section H is particularly suited for and capable of being worked and flexed without adverse effects and is freely supported and movable within the mattress in such a manner that it can and will move to relieve those strains and stresses which might be exerted thereon during normal use of the bed structures.

It will be apparent that the heater structure provided by the present invention is extremely simple and economical to make and is such that it can be easily and conveniently related with a flotation mattress without the exercise of any special skills, tools and/or equipment.

Having described only one typical preferred form and application of the invention, we do not wish to be limited to the specific details herein set forth but wish to reserve to ourselves any modification and/or variations that may appear to those skilled in the art and which fall within the scope of the following claims:

Having described our invention, we claim:

1. In combination, a flotation mattress for water beds comprising a water-proof bladder of flexible plastic sheet material having flat, horizontal top and bottom walls, vertical side and end walls and an elongate tubular filler neck with an inner end fixedly related with an opening in one wall of the mattress and extendable outwardly therefrom and having an open outer end, a volume of water within and slackily filling the mattress, an elongate flexible electric heater with an elongate flexible power supply section with a pair of longitudinally extending electrically insulated power lines and having inside and outside portions, said outside portion having an outer free end connected with an electric power supply, a filler neck engaging plug on the power section between the inside and outside portions thereof and engaged in the outer open end portion of the stem with said inside portion extending longitudinally through the stem and into the mattress, an elongate temperature responsive control section with inner and outer ends, means sealingly coupling the outer end of the control section with the inner end of said inside portion and positioned in the water within the mattress, an elongate flexible electric heater section with inner and outer ends positioned within and extending about the interior of the mattress and within the water therein, said heater section has an elongate electrically insulated resistance element extending longitudinally from its outer end to its inner end and thence to its outer end, means sealingly coupling the inner end of the control section with the outer end of the heater section, said control section including an elongate tubular metal heat conducting body normally in heat conducting contact with the water in the mattress, a normally closed temperature responsive switching device with a pair of terminals positioned within the body in heat conducting contact therewith with one terminal connected with one end of the resistance element and the other terminal connected with one of said power lines and means in the body connecting the other end of the resistance element with the other power lines said power supply and heater sections including flexible ground lines extending longitudinally therethrough and means in the body connecting said ground lines.

2. The combination flotation mattress and heater set forth in claim 1 wherein the element has end portions extending into the body in electric insulated relationship with the body and the device to normally heat said body and device.

3. The combination flotation mattress and heater set forth in claim 1 wherein the outer end of said stem is externally threaded and which includes a screw cap engaged about the neck and engaging the plug to hold the plug in the neck, said cap has a central opening through which the outside portion of the power section extends.

4. The combination flotation mattress and heater set forth in claim 3 wherein the outer end of said stem is externally threaded and which includes a screw cap engaged about the neck and engaging the plug to hold the plug in the neck, said cap has a central opening through which the outside portion of the power section extends.

5. The combination flotation mattress and heater set forth in claim 3 wherein the element has end portions extending into the body in electric insulated relationship with the body and the device to normally heat said body and device.

6. The combination flotation mattress and heater set forth in claim 5 wherein the outer end of said stem is externally threaded and which includes a screw cap engaged about the neck and engaging the plug to hold the plug in the neck, said cap has a central opening through which the outside portion of the power section extends.

7. The combination flotation mattress and heater set forth in claim 1 wherein the power lines of the power section are flexible resistance electrical conductors and are insulatively arranged within a water impervious electrically insulative jacket structure, said element in the heater is a flexible high resistance electric conductor, the resistance of which decreases as the temperature of the element increases, whereby the element is substantially temperature self-regulating, said element is insulatively arranged within a water impervious electrically insulative jacket.

8. The combination flotation mattress and heater set forth in claim 7 wherein the outer end of said stem is externally threaded and which includes a screw cap engaged about the neck and engaging the plug to hold the plug in the neck, said cap has a central opening through which the outside portion of the power section extends.

9. The combination flotation mattress and heater set forth in claim 7 wherein the outer end of said stem is externally threaded and which includes a screw cap engaged about the neck and engaging the plug to hold the plug in the neck, said cap has a central opening through which the outside portion of the power section extends.

* * * * *